United States Patent [19]

Koda et al.

[11] 4,452,571

[45] Jun. 5, 1984

[54] MULTIPLE CYLINDER ROTARY COMPRESSOR

[75] Inventors: Toshihide Koda; Shuji Fujisaki; Kotaro Yoshida; Susumu Kawaguchi; Ken Asada, all of Shizuoka, Japan

[73] Assignee: Mitsubishi Denki Kabushiki Kaisha, Tokyo, Japan

[21] Appl. No.: 389,884

[22] Filed: Jun. 18, 1982

[30] Foreign Application Priority Data

Jun. 19, 1981 [JP] Japan ..... 56-90772

[51] Int. Cl.[3] ..... F04B 49/02; F04B 49/06; F04B 49/08

[52] U.S. Cl. ..... 417/286; 417/292; 417/293; 417/295; 417/310

[58] Field of Search ..... 417/286, 287, 288, 292, 417/293, 295, 310; 418/60

[56] References Cited

U.S. PATENT DOCUMENTS 2,350,537 6/1944 Scott ..... 417/295 X
4,382,749 5/1983 Teegarden et al. ..... 417/295

FOREIGN PATENT DOCUMENTS 9145 4/1980 European Pat. Off. ..... 295/

*Primary Examiner*—Richard E. Gluck
*Attorney, Agent, or Firm*—Bernard, Rothwell & Brown

[57] ABSTRACT

A multiple cylinder rotary compressor in which a capacity control is effected in response to a fluctuating load so that a saving of energy to be consumed is intended by means of such control that a supply of a low-pressure refrigerant gas is interrupted with respect to eigher compression element of at least two compression elements in the multiple cylinder rotary compressor etc.

15 Claims, 10 Drawing Figures

MULTIPLE CYLINDER ROTARY COMPRESSOR

BACKGROUND OF THE INVENTION

1. Field of the Invention

The present invention relates to a multiple cylinder rotary compressor, and particularly to a multiple cylinder rotary compressor in which a capacity control is effected in response to a fluctuating load.

2. Description of the Prior Art

Heretofore, such an apparatus as shown in FIGS. 1 and 2 has been proposed as such type of the multiple cylinder rotary compressor as mentioned above. However, such rotary compressor has various disadvantages as described hereinbelow. Namely, in FIGS. 1 and 2, a driving shaft 1 has eccentric portions 1*a* and 1*b*, and cylinders 2*a* and 2*b* define compression spaces 3*a* and 3*b* being concentric with respect to the driving shaft 1 on the inner peripheral portions thereof. Rolling pistons 4*a* and 4*b* are driven by means of the eccentric portions 1*a* and 1*b* of the driving shaft 1 and roll along the inner peripheral walls of the cylinders 2*a* and 2*b*, respectively. Plate type vanes 5*a* and 5*b* urge the outer peripheral portions of the rolling pistons 4*a* and 4*b* in their axial directions and partition the compression spaces 3*a* and 3*b* into low-pressure and high-pressure sides. The vanes 5*a* and 5*b* mounted within the cylinders 2*a* and 2*b* are urged by means of springs 6*a* and 6*b*, respectively. A driving side plate 7 closes the driving side of the compression space 3*a* and at the same time, is supported on the driving shaft 1 through a bearing (not shown). On the other hand, an anti-driving side plate 8 closes the anti-driving side of the compression space 3*b* and at the same time, is supported on the driving shaft 1 through a bearing. A partition plate 9 isolates the compression spaces 3*a* and 3*b* from one another and closes openings thereof, respectively. A closed container 10 contains the compression elements as described hereinabove. A low-pressure gas suction pipe 11 supplies a low-pressure refrigerant gas to low-pressure parts of the compression spaces 3*a* and 3*b*.

Operation of the conventional rotary compressor as mentioned above will be described hereinbelow.

The rolling pistons 4*a* and 4*b* roll along the inner peripheral walls of the cylinders 2*a* and 2*b* in response to the rotation of the driving shaft 1. As the result, a low-pressure refrigerant gas is sucked into the low-pressure parts of the compression spaces 3*a* and 3*b* through the low-pressure suction pipe 11 to be compressed therein. Consequently such gas is fed to a refrigerating circuit disposed outside the closed container 10 from a high-pressure discharge pipe (not shown) as a refrigerant gas at a high temperature and high pressure. In this refrigerating circuit, the refrigerant gas at a high temperature and high pressure cools a load to be cooled thereby to discharge the energy. Thus, such refrigerant gas is converted to the one at a low temperature and low pressure, the resulting refrigerant gas is refluxed to the low-pressure gas suction pipe 11, and the same operation is again repeated, whereby cooling for the cooling load to be cooled is continued.

However, there is such a disadvantage in the conventional rotary compressor as mentioned above that in the case where rotation of the driving shaft is variable, e.g., a driving shaft for motorcars or the like, when the rotation of the driving shaft increases, a discharge of the refrigerant per unit time also increases so that it results in overcooling. Furthermore, there are also such disadvantages in the case where a rotational frequency of the driving shaft is constant that if atmospheric temperature is relatively low, it results in overcooling so that extra power is used wastefully and an ON-OFF frequency increases to bring about uncomfortableness in the car interior.

SUMMARY OF THE INVENTION

It is the principal object of the present invention to eliminate the disadvantages as mentioned above involved in conventional rotary compressors and to provide a rotary compressor by which a saving of energy to be consumed is intended by means of such control that a supply of a low-pressure refrigerant gas is interrupted with respect to either compression element of at least two compression elements in the multiple cylinder rotary compressor, or the like manner.

Another object of the present invention is to provide a rotary compressor in which a saving of energy to be consumed is contemplated by detecting a rotational frequency of the driving shaft or a temperature of the car interior and the like, whereby a supply of a low-pressure refrigerant gas is ceased with respect to some cylinders in a plurality of the cylinders.

In accordance with an aspect of the present invention to attain the above described objects, there is proposed a multiple cylinder rotary compressor wherein compression elements composed of each cylinder on the inner peripheral portion of which concentric compression spaces with respect to its driving shaft are defined; rolling pistons rolling along the inner peripheral wall of the aforesaid cylinder driven by means of eccentric portions on the aforesaid driving shaft; and vanes each urging the outer peripheral portion of each rolling piston to divide each compression space into a low-pressure and high-pressure sides are arranged in parallel to each other through a partition plate, characterized in that a check valve is disposed in a low-pressure gas suction passage communicating with the low-pressure side of the aforesaid compression space and at the same time, an openable and closable control valve communicating to the high-pressure side of the aforesaid compression space is provided so as to communicate with the aforesaid suction passage.

DETAILED DESCRIPTION OF THE PREFERRED EMBODIMENTS

Figure 1:
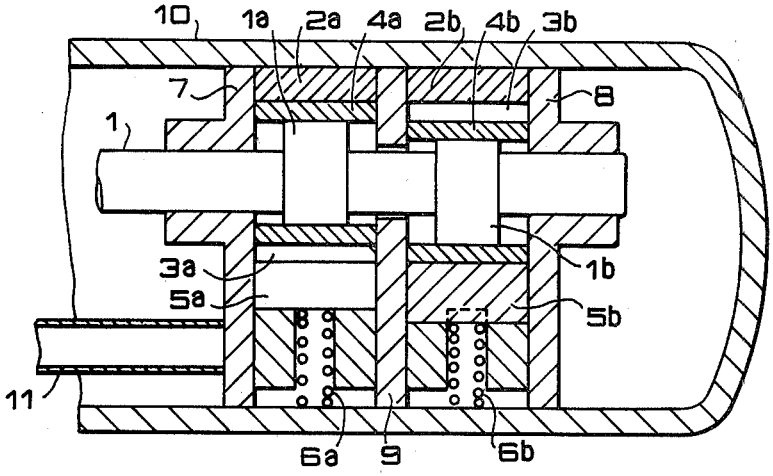
FIG. 1 (PRIOR ART)
FIG. 1 is a longitudinal sectional view showing an essential part of a conventional multiple cylinder rotary compressor.
Figure 2:
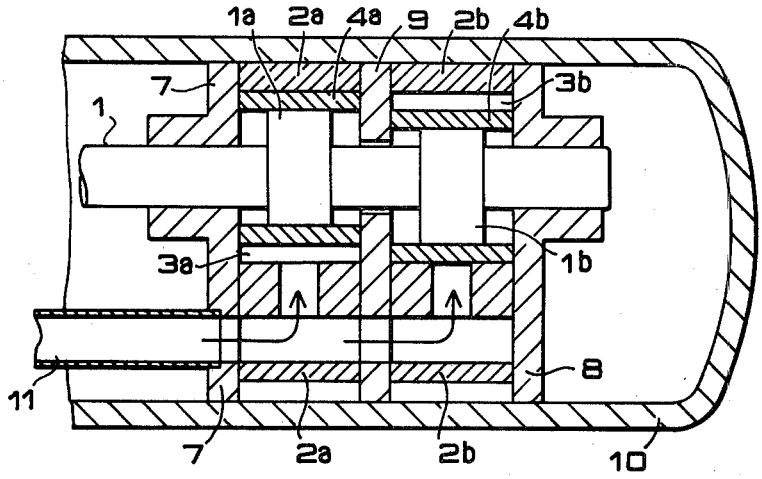
FIG. 2 (PRIOR ART)
FIG. 2 is a sectional view showing a suction passage part of the rotary compressor in FIG. 1.
Figure 3:
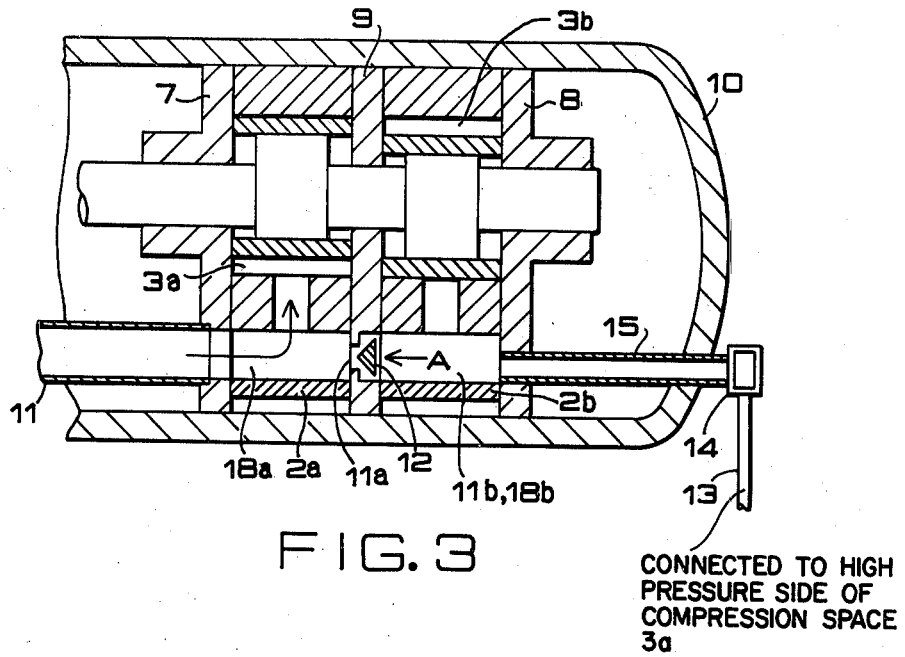
FIG. 3 is a sectional view showing a suction passage part of a multiple cylinder rotary compressor in accordance with the first embodiment of the present invention.

FIG. 3 is a sectional view illustrating the first embodiment of the present invention wherein the same reference numerals as those of FIGS. 1 and 2 designate the same or corresponding parts throughout the view in which a check valve 12 is provided in a suction passage 11*a* of a partition plate 9. The check valve 12 usually opens the suction passage 11*a* and is closed by gas pressure applied from the direction indicated by an arrow A. A conduit 13 is communicated with the high pressure side of compression space 3*a* in a closed container 10 from the outside thereof through a control valve 14. The control valve 14 is composed of a magnetic valve which is opened and closed by means of an electrical signal. To the magnetic valve 14, a connecting pipe 15 communicated with a suction passage 11*b* is further connected. Moreover a first and second suction chambers 18*a* and 18*b* are defined at the opposite sides of the suction passage 11*a* of the aforesaid partition plate 9, respectively.

In a device as constructed above, the following operations are required in the case where it is intended to decrease a quantity of flow of a refrigerant gas circulating through a compressor and a refrigerating circuit whereby output of the compressor is reduced. Namely, the magnetic valve 14 is opened at first, so that a high pressure gas is applied to the check valve 12 in a direction indicated by the arrow A through the connecting pipe 15 to close the check valve 12. As a result, a low-pressure refrigerant gas does not feed to the compression space 3*b* of a cylinder 2*b* so that a rolling piston 4*b* races. Thus, the quantity of flow of the circulating refrigerant gas discharged from a discharge pipe decreases, and after all, power consumed reduces also.

Figure 4:
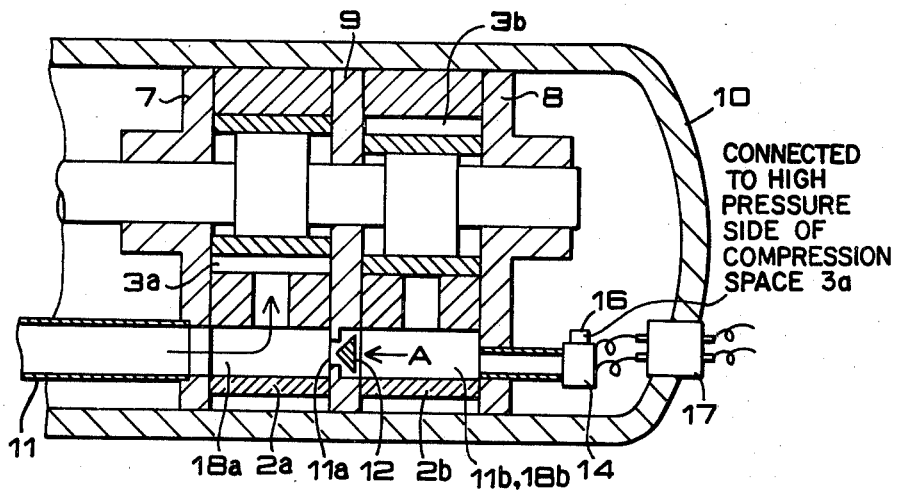
FIG. 4 is a sectional view showing another suction passage part of a rotary compressor according to the second embodiment of the present invention.

Referring to FIG. 4 which is a sectional view illustrating the second embodiment of the present invention. Although the aforesaid first embodiment relates to a rotary compressor in which the magnetic valve 14 is provided on the outside of the closed container 10, in this second embodiment, a magnetic valve 14 is provided for inside a closed container 10 and a conduit 16 communicated with a high pressure side of a compression space 3*a* is connected to the magnetic valve 14 as shown in FIG. 4. As a consequence, a construction of the rotary compressor can simply be made in the second embodiment in which reference numeral 17 designates an enclosed terminal provided through the closed container 10 and for transmitting an electrical signal to the magnetic valve 14. As an electrical signal for actuating the magnetic valve 14, signals obtained in accordance with a rotational frequency of a driving shaft 1 or those obtained from a sensor and the like for detecting a temperature at the interior of a car are utilized.

It is to be noted that though the valve 12 is disposed in a suction passage 11*a* of a partition plate 9 in the second embodiment, the valve 12 may be placed on any other positions so far as it is within the suction passage 11*a*.

Figure 5:
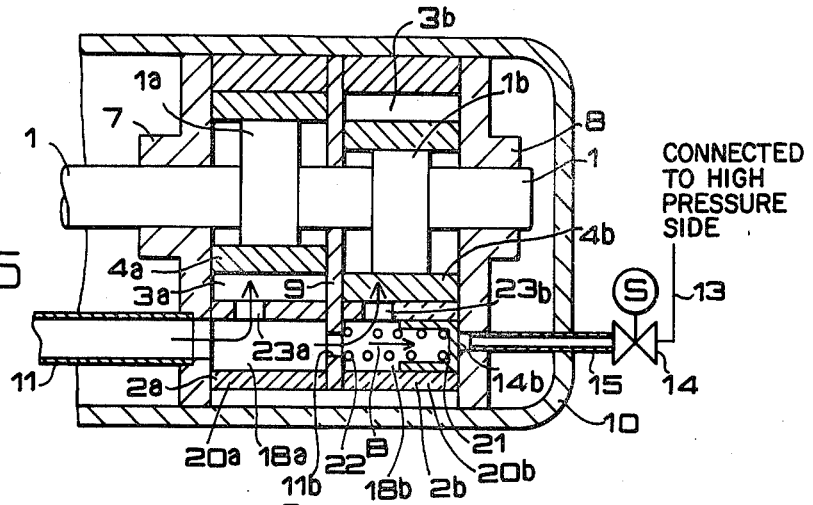
FIGS. 5 and 6 are sectional views each showing an essential part of a two cylinder rotary compressor according to the third embodiment of the present invention.
Figure 6:
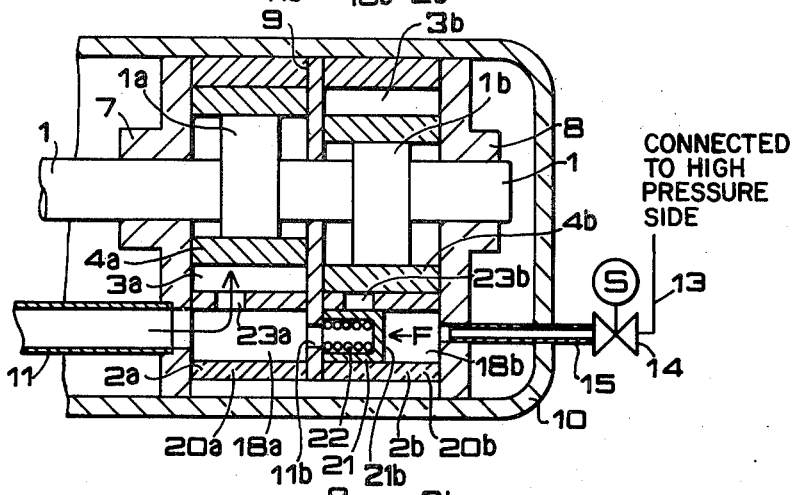

Next, the third embodiment of the present invention will be described by referring to FIGS. 5 and 6 wherein the same reference numerals as those of FIGS. 1 and 2 designate the same or corresponding parts throughout the views of FIGS. 5 and 6. In accordance with the rotary compressor of this third embodiment, an intake chamber 18*b* for a compression element 20*b* being downstream with respect to the flow of an intake refrigerant gas is provided with a cylindrical slider 21 having a very narrow clearance in reference to the intake chamber 18*b* and a spring 22 for affording force along the axial direction to the slider 21. The slider 21 is slid in the intake chamber 18*b*, whereby positional relationship of a suction port 23*b* and the slider 21 is established so as to open and close the suction port 23*b*. Suction port 23*b* is one of suction ports in the compressor and communicating a suction passage 11*b* with a low-pressure chamber of the compression element 20*b*. Furthermore a control valve 14 communicating openably and closably with the high-pressure side is provided on the anti-suction side of the slider 21. In the third embodiment, reference numeral 18*a* designates an intake chamber, 20*a* another compression element, and 23*a* another suction port, respectively.

Then, operation of the rotary compressor in accordance with the third embodiment will be described hereinbelow.

First, in the case where the control valve 14 communicating openably and closably with the high-pressure side is closed, there is no difference in pressure between the suction and anti-suction sides of the slider 21. Consequently, the slider 21 is urged by means of the spring 22 along the direction of the anti-suction side to collide with the surface of wall of a reaction side plate 8. In this condition, the suction port 23*b* communicating the suction passage 11*b* with the low pressure chamber is opened. Thus, a low pressure refrigerant gas is supplied to the compression elements 20*a* and 20*b*, respectively, so that the rotary compressor according to the third embodiment is operated with the same performance as that of a conventional rotary compressor. On the other hand, in the case where the control valve 14 communicating openably and closably with its high-pressure side is opened as shown in FIG. 6, if it is assumed that a sectional area of the slider 21 is S $cm^2$ in the anti-suction side 21*b* and a difference in pressure between the high-pressure and suction sides is $\Delta P$ $kg/cm^2$, force $F=\Delta P \times S$ kg acts on the slider 21 in a direction indicated by an arrow F in FIG. 6. In accordance with combinations of the force F and load characteristics of the spring 22, the slider 21 can be moved with an arbitrary difference in pressure. And when the slider 21 moves along the direction indicated by the arrow F, the suction port 23*b* communicating the suction passage 11*b* with the low-pressure chamber of the compression element 20*b* is closed. As a result, functions of compressing and discharging a low-pressure refrigerant gas upon one compression element 20*b* of two compression elements 20*a* and 20*b* are stopped. After all, it is possible that the air cooling capacity of the rotary compressor in the third embodiment is reduced substantially half the one in a conventional compressor and at the same time its power consumption is decreased.

Again, when the control valve 14 communicating with the high-pressure side is made to be closed, since there is a very narrow clearance between the slider 21 and the suction passage 11b as mentioned above, a high-pressure gas on the side of the anti-suction pipe leaks away gradually. Hence, when a difference in pressure in the front and in the rear of the slider 21 becomes small, the slider 21 is shifted by means of force of the spring 22 along the direction indicated by the arrow B shown in FIG. 5 so that it returns the rotary compressor to its usual operational condition.

In the above described embodiment, it is to be noted that the control valve for opening and closing the high-pressure side may be disposed either inside or outside the container containing the compression elements. In this case, a control is effected on the basis of a rotational frequency of the driving shaft or a result obtained by sensing a temperature in a car interior.

Figure 7:
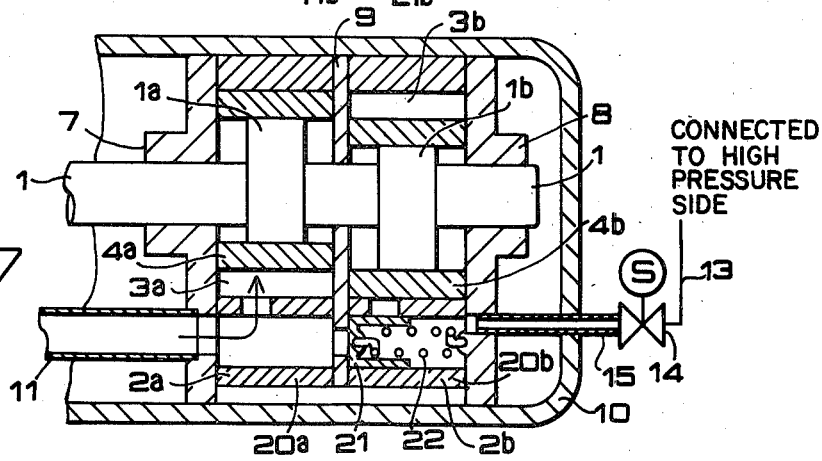
FIG. 7 is a sectional view showing an essential part of another rotary compressor in accordance with the fourth embodiment of the present invention.

In addition, the slider may be any form by which the suction port can be opened and closed, and the spring may also be any type of the one which can afford force upon the slider along the axial direction thereof. Further the spring 22 may be a tension spring stretching the slider 21 towards the anti-suction side as shown in FIG. 7.

Figure 8:
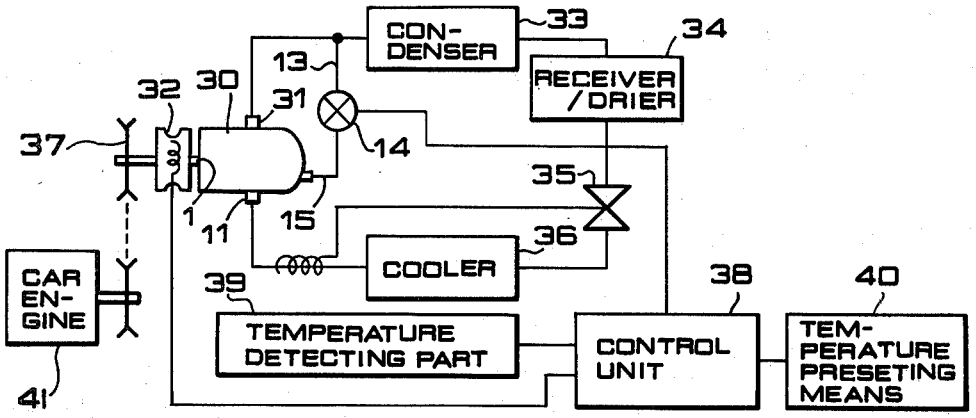
FIG. 8 is a cooler system diagram in which a compressor according to the present invention is applied to a car air conditioner.
Figure 9:
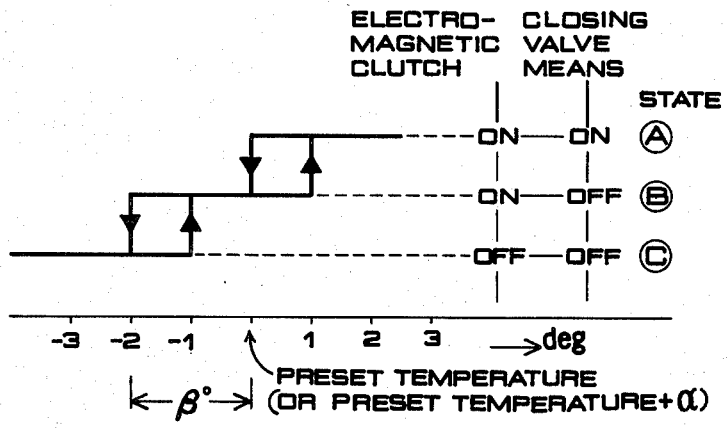
FIG. 9 is a graphical representation illustrating control characteristics of a control unit in the case where the present invention is applied to the cooler system of FIG. 8.
Figure 10:
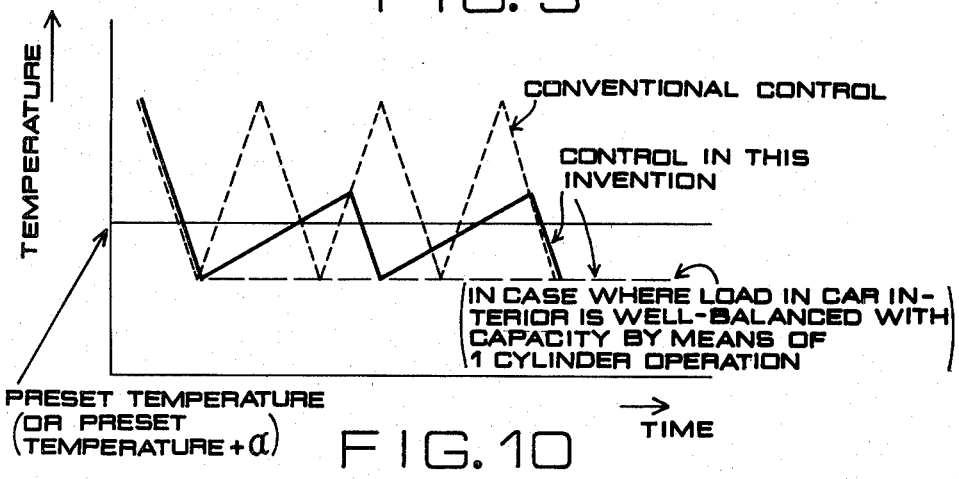
FIG. 10 is a graphical representation illustrating temperature characteristics in the case where the present invention is applied to the cooler system of FIG. 8.

In the following, a control for a refrigerating cycle apparatus wherein the above-mentioned compressor is utilized, i.e., a car air cooling system will be described by referring to FIGS. 8–10. In FIG. 8, the same reference numerals as those of FIGS. 3–7 designate the same or corresponding parts throughout the view thereof in which a rolling piston type capacity variable compressor 30 is provided with a single discharge port 31 and a suction pipe 11 having an intake for a cylinder. The compressor 30 is further provided with an electromagnetic clutch 32 being connected to a car engine 41 through a pulley 37. A condenser 33 for condensing a high-pressure gas fed from the discharge port 31 is connected to this discharge port of the compressor 30. A refrigerant liquid at a high temperature and pressure being condensed by means of the condenser 33 is transferred to a receiver/drier 34 and stored therein. A throttle device 35 composed of an expansion valve varying an amount of the refrigerant to be throttled in response to an evaporated state of the refrigerant is connected to the receiver/drier 34. Moreover a cooler 36 for evaporating the refrigerant liquid, which has been kept in a low temperature and pressure condition by means of the expansion valve 35 thereby to take ambient heat away, is disposed in between the expansion valve 35 and the suction pipe 11 of the compressor 30. A piping for introducing the refrigerant fed from the cooler 36 into the intake 11 for the compressor 30 is provided. The cooling cycle apparatus is further provided with a unit 38 for controlling the above-mentioned electromagnetic clutch 32 and the magnetic valve 14 by means of a temperature sensing part 39 and a temperature presetting means 40 disposed in the interior of a car. Control characteristics of the control unit 38 are as illustrated in FIG. 9. Then, operation of the car air cooling system constructed as stated above will be described hereinbelow.

The control unit 38 compares a temperature measured in the temperature sensing part 39 composed of a thermistor or the like by which either a suction temperature or a blow-off temperature of the cooler 36 is sensed with a temperature preset by means of the temperature presetting means 40 placed in the car interior, so that the control unit 38 transmits output to the electromagnetic clutch 32 and the magnetic valve 14 in accordance with the graphical representation illustrating the control characteristics in FIG. 9. More specifically, as illustrated in FIG. 9, both the electromagnetic clutch and a closing valve means (magnetic valve) are ON (state (A)) until the temperature reaches a preset temperature (or the present temperature$+\alpha$). Then, when the electromagnetic clutch 32 is turned ON, driving force of an engine is transmitted to the compressor 30, thereby operating the compressor. The closing valve means 14 is turned ON, whereby a stream of the refrigerant flowed from the cooler 36 is introduced into each cylinder of the compressor 30. Hence compression is effected in two cylinders so that the compressor cools rapidly the car interior with the maximum capacity to make a temperature in the car interior close to the preset temperature. As a consequence, when a temperature detected by the temperature detecting part 39 is lower than the preset temperature (or preset temperature$+\alpha$), the electromagnetic clutch is kept in the ON state, whereas the closing valve means remains at OFF (state (B)). Upon turning the closing valve means OFF, a valve means disposed therein is driven to stop the introduction of a flow of the refrigerant which was flowing just now through each suction port of the compressor 30 into either of the cylinders. Because of such adjustment, the compressor 30 is actuated by means of one of the cylinders so that a capacity of the compressor 30 is reduced by half, and air cooling in the car interior is effected in this condition. Thereafter, if a required load in the car interior is well-balanced with the air cooling capacity in the operation by means of a single cylinder of the compressor 30, such compressor is operated with a state remaining unchanged. However, when the load in the car interior becomes larger than the air cooling capacity by a single cylinder operation, the compressor is again operated by means of two cylinders with the maximum capacity accompanied with a certain degree of hysteresis (indicated by 1 deg. in FIG. 9). On the contrary, when the load in the car interior is small and a temperature detected by the temperature detecting part 39 becomes lower than the preset temperature (or preset temperature$+\alpha$) by $\beta$ degree (indicated by 2 deg. in FIG. 9), the electromagnetic clutch 32 is turned OFF so that the compressor 30 is operated by either one cylinder or two cylinders. Under the circumstance, a temperature difference between the preset temperature and the blow-off temperature (or suction temperature) in the control unit as described above is smaller than that of a conventional control unit. Furthermore, in this case of the compressor according to the present invention, a climbing gradient of a blow-off temperature (or suction temperature) is raised while the compressor 30 is operated by means of one cylinder so that the raise of which is gradually carried out. In addition, in the case where a load in the car interior is well-balanced with a capacity operated by means of one cylinder, a constant blow-off temperature (or suction temperature) is attained so that comfortable air cooling can be obtained. Besides, according to the control unit of the present invention, the compressor 30 is repeatedly driven by means of one cylinder and two cylinders during a season where air-conditioning or air cooling is generally performed. For this reason, the compressor 30 is always operated unlike such a case where operation of the compressor is sometimes ceased as in a conventional control unit, so that wasteful power at the time of starting the compressor can be saved. The rotary compressor according to the present invention detects a rotational frequency of the driving shaft, a temperature of the car interior or the like to carry out opening or closing of a control valve being openable and closable and communicating with the high-pressure side of the compressor on the basis of such signal detected as above, whereby a capacity of the compressor can be controlled. Accordingly a pertinent operation can be effected by the rotary compressor according to the present invention, if the compressor is applied to the case of over air cooling because of too much rotational frequency of its driving shaft or a case where a load in air cooling is small in a motorcar and the like wherein a rotational frequency of its driving shaft is variable. As the result, a required power can be reduced, and an ON-OFF frequency of the compressor can also be decreased so that comfortableness in air cooling can remarkably be improved in the rotary compressor according to the present invention.

What is claimed is:

1. A multiple cylinder rotary compressor comprising:

(a) a driving shaft rotated by means of a driving means;

(b) first and second cylinders disposed within a shell containing compression elements each compressing a refrigerant and defining at least first and second compression spaces on the inner peripheral portion of said shell;

(c) first and second rolling pistons provided within said cylinders and rolling along the inner peripheral wall of said cylinders accompanied with rotation of said driving shaft;

(d) first and second vanes for dividing said first and second compression spaces, respectively, into low-pressure and high-pressure sides by engaging the inner peripheral wall of said cylinders or the outer peripheral portions of said first and second rolling pistons;

(e) a partition plate for separating said first compression space from said second compression space;

(f) a low-pressure gas suction pipe communicating with each low-pressure side of said first and second compression spaces to supply a low-pressure gas refrigerant thereto;

(g) a valve means disposed in a communication passage for communicating each low-pressure side of said first and second spaces with one another; and (h) control pipes provided for communicating the low pressure sides of said compression spaces substantially stopping the compression function of one of said cylinders in response to opening and closing actions of said valve means with the high-pressure side of said first or second compression spaces through a control valve being openably and closably controlled.

2. A compressor as defined in claim 1, wherein said control valve is disposed inside said shell.

3. A compressor as defined in claim 1, wherein said control valve is disposed outside said shell.

4. A compressor as defined in claim 1, wherein said valve means is a check valve being opened and closed in response to a difference in pressure between opposite ends thereof.

5. A compressor as defined in claim 1, wherein a driving means for rotating said driving shaft is an electric motor or an engine.

6. A compressor as defined in claim 5, wherein a clutch is provided between said driving shaft and said driving means.

7. A compressor as defined in claim 1, wherein a first and second intake chambers communicating with the respective low-pressure sides of said first and second compression spaces are provided within said cylinders, these intake chambers are partitioned by means of said partition plate, and at the same time said partition plate is provided with said valve means.

8. A compressor as defined in claim 7, wherein said valve means is a check valve being opened and closed in response to a difference in pressure between opposite ends thereof.

9. A compressor as defined in claim 7, wherein said suction pipe is connected to said first and second intake chambers, and said control pipe is connected with said second or first intake chamber.

10. A compressor as defined in claim 1, wherein said valve means is actuated in response to a rotational frequency of said driving shaft.

11. A compressor as defined in claim 1, wherein said valve means is actuated in response to a refrigerating cycle load.

12. A compressor as defined in claim 11 further comprising a car interior temperature sensor for detecting said refrigerating cycle load.

13. A multiple cylinder rotary compressor comprising:

(a) a driving shaft rotated by means of a driving means;

(b) first and second cylinders disposed within a shell containing compression elements each compressing a refrigerant and defining at least first and second compression spaces on the inner peripheral portion of said shell;

(c) first and second rolling pistons provided within said cylinders and rolling along the inner peripheral wall of said cylinder accompanied with rotation of said driving shaft;

(d) a first and second vanes for dividing said first and second compression spaces, respectively, into low-pressure and high-pressure sides by engaging the inner peripheral wall of said cylinders or the outer peripheral portions of said first and second rolling pistons;

(e) a partition plate for separating said first compression space from said second compression space;

(f) a first and second intake chambers disposed within said cylinder and communicating with the respective low-pressure sides of said first and second compression spaces;

(g) a low-pressure gas suction pipe for supplying a low-pressure gas refrigerant to said first and second intake chambers;

(h) a check valve disposed in a communication passage for communicating each low-pressure side of said first and second spaces and being opened and closed in response to a difference in pressure between opposite ends thereof; and (i) control pipes provided for communicating the low-pressure sides of said compression spaces substantially stopping the compression function of one of said cylinders in response to opening and closing actions of said check valve with the high-pressure side of said first or second compression spaces through a control valve being openably and closably controlled.

14. A compressor as defined in claim 13, wherein a driving means for rotating said driving shaft is an electric motor or an engine.

15. A compressor as defined in claim 14, wherein a clutch is provided between the driving shaft and said driving means.

* * * * *

UNITED STATES PATENT AND TRADEMARK OFFICE

CERTIFICATE OF CORRECTION

PATENT NO. : 4,452,571

DATED : June 5, 1984

INVENTOR(S) : Toshihide Koda et al.

It is certified that error appears in the above-identified patent and that said Letters Patent is hereby corrected as shown below:

On the title page under "Foreign Application Priority Data", "56-90772" should read --56-90772[U]--.

In the Abstract, line 6, "eigher" should read --higher--.

Signed and Sealed this

*First* Day of *January 1985*

[SEAL]

*Attest:*

GERALD J. MOSSINGHOFF

*Attesting Officer*

*Commissioner of Patents and Trademarks*